United States Patent [19]

Kato et al.

[11] 4,409,024

[45] Oct. 11, 1983

[54] TOP-AND-BOTTOM BLOWN CONVERTER STEEL MAKING PROCESS

[75] Inventors: Yoshiei Kato; Tsutomu Nozaki; Kyoji Nakanishi, all of Chiba, Japan

[73] Assignee: Kawasaki Steel Corporation, Hyogo, Japan

[21] Appl. No.: 385,407

[22] PCT Filed: Sep. 19, 1981

[86] PCT No.: PCT/JP81/00239

§ 371 Date: May 17, 1982

§ 102(e) Date: May 17, 1982

[87] PCT Pub. No.: WO82/01012

PCT Pub. Date: Apr. 1, 1982

[30] Foreign Application Priority Data

Sep. 19, 1980 [JP] Japan ..... 55-131402

[51] Int. Cl.[3] ..... C21C 5/32; C21C 5/34

[52] U.S. Cl. ..... 75/60; 75/52; 75/59

[58] Field of Search ..... 75/60, 52, 59; 266/47, 266/218

[56] References Cited

U.S. PATENT DOCUMENTS

| | | | |
|---|---|---|---|
| 4,302,244 | 11/1981 | Sieckman | 75/60 |
| 4,308,057 | 12/1981 | Ono | 75/60 |
| 4,334,921 | 6/1982 | Hirai | 75/60 |
| 4,356,035 | 10/1982 | Brotzmann | 75/60 |

*Primary Examiner*—P. D. Rosenberg

*Attorney, Agent, or Firm*—Wenderoth, Lind & Ponack

[57] ABSTRACT

In the top-and-bottom blown converter steel making process, a process is provided wherein the position of the bottom-blowing tuyeres is set such that the maximum $X_0$ among the distances X between the respective tuyeres and the center of the converter bottom is up to 1.3 times the horizontal distance Y between the central vertical axis of the converter and the outermost boundary of a hot spot region developed on the molten iron surface by the top-blowing oxidizing gas from the lance. By setting the position of the bottom blowing tuyeres in this manner, the interference of the bottom-blowing gas with the top-blowing gas is promoted to enhance the agitation between the slag and the metal to reduce the concentration of iron value (T.Fe) in the slag, thereby improving the iron yield.

8 Claims, 7 Drawing Figures

TOP-AND-BOTTOM BLOWN CONVERTER STEEL MAKING PROCESS

TECHNICAL FIELD

This invention relates to a top-and-bottom blown converter steel making process of the type wherein an oxidizing gas such as pure oxygen is blown onto the surface of molten steel in the converter through a lance disposed above the molten iron surface while a gas for agitation such as an oxidizing or inert gas is blown into the molten iron through tuyeres arranged at the bottom of the converter, and more particularly relates to the position of the tuyeres for blowing the bottom-blowing gas.

BACKGROUND ART

Considerable attention has been paid for many years to the bottom-blown converter steel making process as a substitute for the conventional top-blown converter steel making process. This bottom-blown converter steel making process has some advantages over the top-blown converter steel making process. For example, since the agitation of molten iron is substantially enhanced as compared with the top-blown converter steel making process, the concentration of total iron value (T.Fe) in a slag is substantially reduced, and as a result, the iron yield of the steel making process is substantially increased.

It is, however, difficult to modify a top-blown converter into a special bottom-blown converter since the bottom-blow converter is substantially different in converter configuration and support structure from the top-blown converter, and it is economically undesirable to totally convert the a top-blown converter steel making process into a bottom-blown converter steel making process in an instant. Under these circumstances, an attempt has been made to somewhat modify the conventional top-blown converter into a converter of the type using bottom blowing in combination with top blowing, that is, a top-and-bottom blown converter which is a top-blown converter taking advantage of bottom blowing. With the assistance of bottom blowing, such a top-and-bottom blown converter steel making process is free from the disadvantages of the top-blown converter steel making process such as weak agitation which causes the concentration of iron value in a slag to increase to reduce the yield of iron, suppressed decarbonization reaction in a low-carbon region, and reduced dephosphorization and desulfurization. However, in the prior art top-and-bottom blown converter steel making process, it was recognized only that agitation could be enhanced simply by providing tuyeres at the bottom of the converter and blowing a gas therethrough, and no further consideration was given to the specific conditions for providing the maximum agitation effect. A sufficient agitation effect was not always achieved despite the addition of bottom blowing.

Bearing the above-mentioned problems in mind, the inventors carried out extensive experimental research to find a technique capable of providing the maximum agitation between slags and metal in the top-and-bottom blowing, or in other words, a technique for deriving the maximum bottom blowing effect when bottom blowing is used in combination in a top-blown converter, and found that agitation is not substantially enhanced as compared with single top blowing unless there is an interference between the action of an oxidizing gas blown from the top and the action of a gas blown from the bottom. Based on this finding, the inventors recognized that, to enhance the agitation effect, a specific relationship must be set between the position of bottom blowing tuyeres and a hot spot which is developed on the molten iron surface by an oxidizing gas injected through the top blowing lance, that is, a region of the molten iron surface which is at a high temperature due to the direct impingement of an oxidizing gas against the molten iron surface. As a result of further experimental research, the inventors have found that the agitation effect is substantially enhanced by setting the position of tuyeres in relation to the hot spot according the following conditions, thereby achieving the object this invention.

DISCLOSURE OF INVENTION

The top-and-bottom blown converter steel making process of this invention is characterized in that blowing is carried out while the position of each of tuyeres arranged at the bottom of the converter is set in relation to the height of the lance and the angle of the injection hole of the lance such that the maximum $X_0$ among the distances X between the respective tuyeres and the center of the converter bottom is up to 1.3 times the horizontal distance Y between the axis of the converter and the outermost boundary of a hot spot region developed by a gas injected from the lance onto the molten steel surface, with the above-mentioned distance Y being according to the following equation (1):

$$Y = L \tan(\theta_1 + \theta_2/2) \quad (1)$$

wherein L is the distance between the injection hole of the lance and the molten steel surface, that is, the so-called lance height, $\theta_1$ is the angle of inclination of the central axis of the lance injection hole with respect to the axis of the converter, and $\theta_2$ is the angle of dispersion of the oxidizing gas injected through the injection hole of the lance.

By setting the position of the tuyeres in relation to the hot spot region as described above, the enhancement of the agitation between slag and metal by the bottom blowing gas becomes a maximum so as to significantly reduce the concentration of iron value (T.Fe) in a slag as compared with the prior art, thereby remarkably improving the iron yield.

Further, by setting the position of half or more of the tuyeres, preferably the position of all the tuyeres arranged at the bottom of the converter such that the distances X between the respective tuyeres and the center of the converter bottom are from 1.0 to 1.3 times the above-mentioned horizontal distance Y, it becomes possible to reduce the adhesion of metal to the lance due to spitting as well as further improving the enhanced agitation between the slag and metal by the bottom blowing gas.

BEST MODE FOR CARRYING OUT THE INVENTION

This invention is further described by referring to the accompanying drawings.

Figure 1:
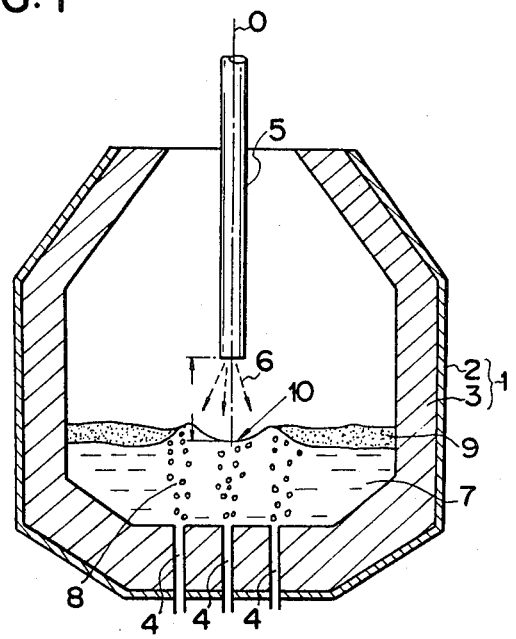
FIG. 1 is a schematic vertical cross-section of one example of a top-and-bottom blown converter for carrying out this invention.

FIG. 1 is a cross section of one example of a top-and-bottom blown converter in which a converter housing 1 comprises an outer shell 2 of steel having a brick lining 3 on the inner surface thereof and is being provided at the bottom with a plurality of tuyeres 4 for bottom blowing. During operation, an oxidizing gas 6, for example, pure oxygen is blown toward the surface of a molten iron 7 in the converter through a lance 5 which is vertically inserted into the converter housing 1 along its axis O from above while a gas 8, for example, an oxidizing or inert gas is blown into the molten steel through the tuyeres 4 at the bottom. It is to be noted that 9 designates a slag layer on the surface of the molten iron.

In the top-and-bottom blown converter of the above-described construction, a portion of the molten iron against which the oxidizing gas 6 from the lance 5 impinges is locally heated to an extremely high temperature to form the so-called hot spot 10 where a gas-metal reaction, for example, decarbonization proceeds rapidly to form iron oxides such as FeO. On the other hand, the gas 8 blown in at the bottom moves upward through the molten iron up to its surface. At this point, if the gas 8 blown in at the bottom acts on the hot spot 10 formed by the oxidizing gas 6 from the lance 5, the interference would enhance the top-and-bottom blowing effect. Specifically, if the iron oxides formed in the hot spot 10 are agitated by the upward flow of the gas 8 from the bottom blowing tuyeres 4, the iron oxides are rapidly reduced to eventually prevent the concentration of iron value in the slag 9 from increasing. If the gas blown in through the bottom blowng tuyeres 4 reaches the molten iron surface at a position remote from the hot spot 10, the above-mentioned interference will not take place to any substantial degree. More specifically, the jet flow of the oxidizing gas from the lance 5 probably causes the slag 9 itself to move outwards in the hot spot region 10. It is thus believed that agitating the hot spot region at or in proximity of its boundary by means of the upward flow of the bottom blowing gas is most effective when the agitation and mixing between the slag and the metal is taken into account.

Figure 2:
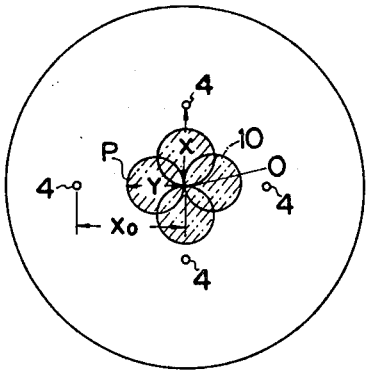
FIG. 2 is a schematic plan view showing the relationship of a hot spot associated with the lance to the position of bottom blowing tuyeres.

It will be understood that the position at which the gas blown in from the bottom blowing tuyeres 4 reaches the surface of molten iron substantially corresponds to the vertical upward extension of the tuyeres 4 at the bottom. Taking this into account, the inventors conceived that the above-mentioned interference is a maximum when the maximum $X_0$ among the distances X between the center of the converter bottom and the respective bottom blowing tuyeres 4 falls within a certain range with respect to the distance Y between the crossing of the axis O of the converter with the molten steel surface and the central vertical outermost boundary of the hot spot 10. The conducted the model experiments as described later to find the conditions for achieving the above relation, and confirmed through experimental operation that these conditions are correct. FIG. 2 is a schematic plan view showing the relationship of the bottom-blowing tuyeres 4 to hot spots 10 developed by the oxidizing gas injected from a lance having a 4-hole nozzle.

Figure 3:
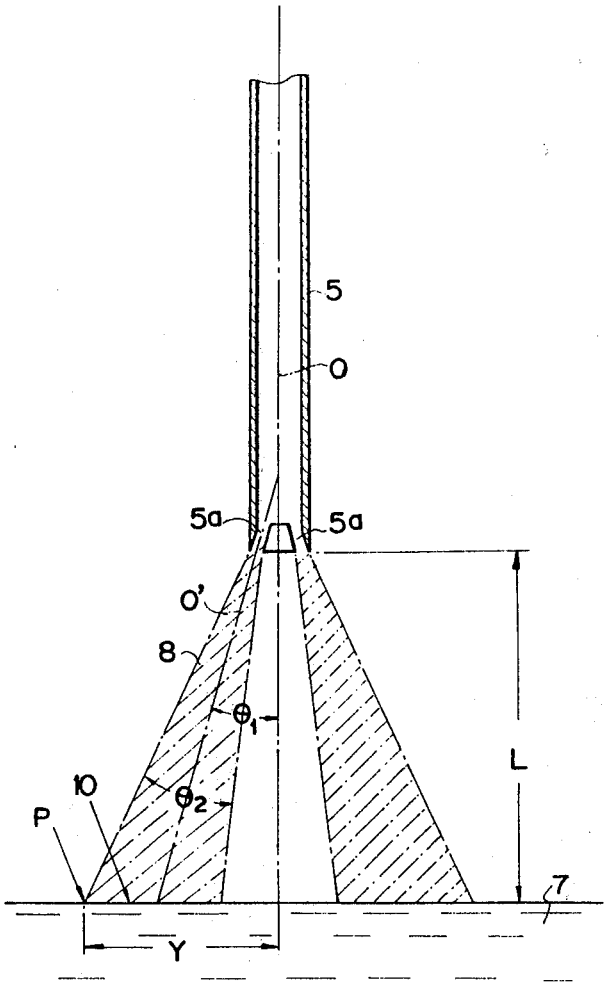
FIG. 3 is a schematic view showing the relationship of the lance to the hot spot.

The distance Y from the central vertical axis O of the converter to the outermost boundary P of the hot spot region 10 is further described with reference to FIG. 3 which illustrates the dispersion of the oxidizing gas 8 discharged from the lance 5 having a 4-hole nozzle. Provided that, in FIG. 3, $\theta_1$ is the angle of inclination of the central axis O' of each injection hole 5a of the lance 5 with respect to the axis O of the converter, $\theta_2$ is the angle of dispersion of the oxidizing gas 8 discharged through each injection hole 5a of the lance (that is, the angle of divergence of each nozzle hole), and L is the distance from the surface of the molten iron 7 to the injection holes 5a of the lance 5, the distance Y from the axis O of the converter to the outermost boundary P of the hot spot region 10 is represented by the following equation (1):

$$Y = L \tan(\theta_1 + \theta_2/2) \quad (1)$$

It was found through experiments that the value of Y calculated in terms of equation (1) agrees with that obtained in the practice of blowing.

Figure 4:
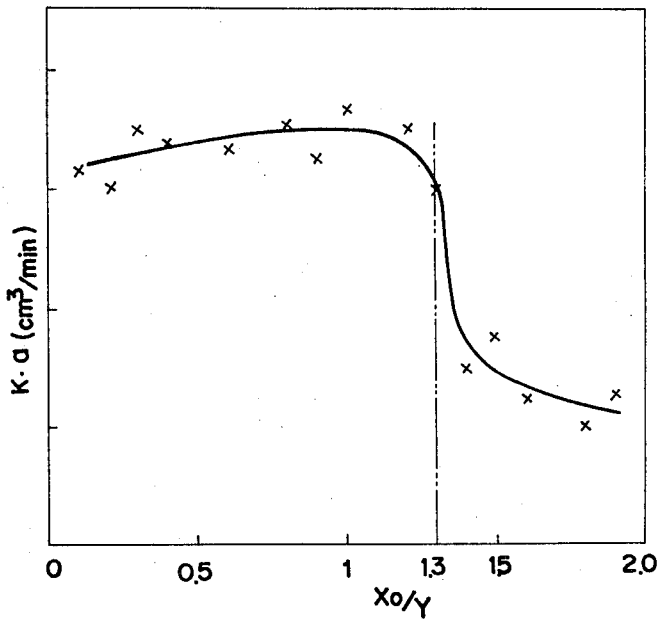
FIG. 4 is a graph showing the relationship of the capacity coefficient of mass transfer $k_a$ to $X_0/Y$ in a model experiment.

A model experiment was conducted by varying the above-described distance Y in relation to $X_0$ as follows. This model experiment used a transparent plastic scale model of a 200-ton converter built on a scale of 1/15. The model converter was charged with water and liquid paraffin having a specific gravity of 0.85 instead of molten iron and slag, respectively. A gas was blown through a 4-hole top-blowing lance and a gas was also blown through bottom-blowing tuyeres while the positions of the tuyeres and the height of the lance were varied to vary the above-described distances Y and $X_0$ and hence, $X_0/Y$. The above-described angles $\theta_1$ and $\theta_2$ associated with the injection hole of the lance were 12° and 20°, respectively. $\beta$-naphthol which is soluble in the water playing the role of the molten iron was previously dissolved in the liquid paraffin playing the role of the slag to determine the rate of transfer of $\beta$-naphthol into water acting as the molten steel during the agitation between the liquid paraffin acting as the slag and the water acting as the molten steel. A capacity coefficient of mass transfer was used as the measure for representing the rate of transfer. FIG. 4 shows how the capacity coefficient of mass transfer $k_a$ of $\beta$-naphthol into water varies with $X_0/Y$. As seen from FIG. 4, the capacity coefficient of mass transfer $k_a$ drastically changes at the value of $X_0/Y = 1.3$, and is higher when $X_0/Y$ is not larger than 1.3 ($X_0/Y \leqq 1.3$). A further study on the data of FIG. 4 indicates that the capacity coefficient of mass transfer $k_a$ is at a peak when the value of $X_0/Y$ is equal to or slightly larter than 1.0 and tends to progressively decrease as the value of $X_0/Y$ decreases from 1.0. These results indicate that there is little interference between the top and bottom blowing gases and hence, little agitation between the slag and the metal when $X_0 > 1.3Y$, whereas the interference abruptly increases and hence, the slag-metal agitation is enhanced when $X_0 \leqq 1.3Y$, and this tendency becomes outstanding particularly when the value of $X_0/Y$ is equal to or slightly larger than 1.0. It was thus found that in order to ensure the enhancement of agitation by the bottom blowing, the position of the bottom-blowing tuyeres must be set so as to satisfy the condition $X_0 \leqq 1.3Y$, preferably so as to satisfy the condition $Y \leqq X_0 \leqq 1.3Y$. Since the distance Y associated with the hot spot 10 varies with the height L of the lance and the angles $\theta_1$ and $\theta_2$ associated with the injection hole of the lance is apparent from the aforementioned equation (1), the above-mentioned conditions may be satisified by properly setting the position of the tuyeres in relation to the lance height L and the angles $\theta_1$ and $\theta_2$.

Examples of this invention are described below together with Comparative Examples.

EXAMPLE 1

Figure 5:
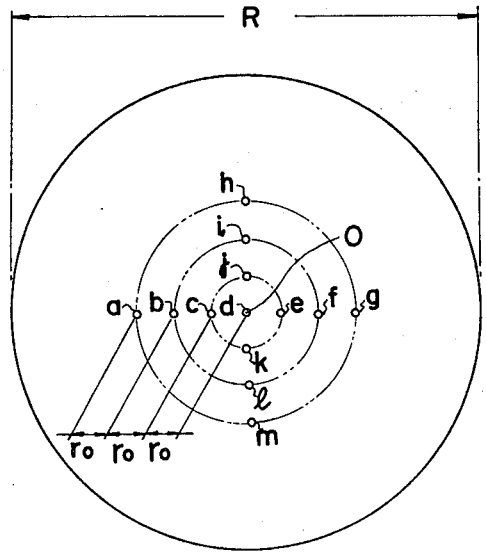
FIG. 5 is a diagrammatic plan view showing the position of the bottom blowing tuyeres in the converter used in Example 1 and Comparative Examples 1 and 2.

In an experimental 5-ton top-and-bottom blown converter, blowing was effected under conditions providing a value of $X_0/Y$ of 1.3 or less. The converter at the bottom had an inner diameter R (see FIG. 5) of 1,000 mm, the bottom-blowing tuyeres used were double-pipe tuyeres each consisting of an inner pipe of 8 mm in inner diameter and an outer pipe for the passage of propane gas as a tuyere protecting gas. As shown in FIG. 5, 13 tuyeres a, b, . . . , m were arranged on concentric circles in symmetry with respect to the center of the converter bottom with the circles spaced at a radial distance $r_0$ of 80 mm, and the value of $X_0/Y$ was adjusted to 1.3 or less by closing some of the tuyeres with a cover of amorphous refractory material and adjusting the lance height L. The lance used had a 4-hole nozzle. The angle of inclination of the central axis of each lance injection hole with respect to the central vertical axis of the converter, $\theta_1$, was 12°, and the angle of dispersion of a gas injected through each injection hole, $\theta_2$, was 20°. Pure oxygen was used as the top and bottom blowing gases. Blowing was completed at a level approximating C 0.05% and sampling was carried out with the converter inclined before the steel was tapped from the converter. Conditions for Runs Nos. 1–7 are shown in Table 1.

COMPARATIVE EXAMPLE 1

Refining by top-and-bottom blowing was conducted in the same manner as above in a top-and-bottom blown converter having tuyeres a–m used in Example 1, except that the value of $X_0/Y$ was adjusted to above 1.3 by selectively closing some of the tuyeres and adjusting the lance height L. The remaining conditions are shown in Table 1, Runs Nos. 8–11.

COMPARATIVE EXAMPLE 2

In a converter having tuyeres a–m similar to those used above, refining by bottom blowing only was conducted without top blowing. The remaining conditions are shown in Table 1, Runs Nos. 12–13.

Analytical values of the molten iron composition prior to blowing and the blowing-out composition in Example 1 and in the Comparative Examples are shown in Tables 2 and 3.

TABLE 1

| | Run No. | Tuyeres used | Number of tuyeres used | $X_0$ (mm) | Flow rate of bottom-blowing gas ($Nm^3$/min.) | Flow rate of top-blowing gas ($Nm^3$/min.) | L (mm) | Y (mm) | $X_0/Y$ |
|---|---|---|---|---|---|---|---|---|---|
| Example 1 | 1 | c,e,j,k | 4 | 80 | 5 | 10 | 400 | 162 | 0.49 |
| | 2 | c,e,j,k | 4 | 80 | 5 | 10 | 500 | 202 | 0.40 |
| | 3 | b,c,e,f | 4 | 160 | 5 | 10 | 400 | 162 | 0.99 |
| | 4 | b,j,f,l | 4 | 160 | 5 | 10 | 350 | 141 | 1.13 |
| | 5 | a,h,g,m | 4 | 240 | 5 | 10 | 460 | 186 | 1.29 |
| | 6 | a,h,g | 3 | 240 | 5 | 10 | 500 | 202 | 1.19 |
| | 7 | a,b,f | 3 | 240 | 5 | 10 | 540 | 218 | 1.10 |
| Comparative Example 1 | 8 | a,h,g,m | 4 | 240 | 5 | 10 | 400 | 162 | 1.49 |
| | 9 | a,b,c,d | 4 | 240 | 5 | 10 | 430 | 174 | 1.38 |
| | 10 | a,b,d | 3 | 240 | 5 | 10 | 350 | 141 | 1.70 |
| | 11 | a,b,f,g | 4 | 240 | 5 | 10 | 400 | 162 | 1.49 |
| Comparative Example 2 | 12 | b,c,j e,f,l | 6 | 160 | 15 | 0 | — | — | — |
| | 13 | a,c,h g,e,m | 6 | 240 | 15 | 0 | — | — | — |

TABLE 2

| | Run No. | Molten iron composition (wt %) C | Si | Mn | P | S | Blowing-out composition (wt %) C | Mn | P | S | T.Fe | Blowing mode |
|---|---|---|---|---|---|---|---|---|---|---|---|---|
| Example 1 | 1 | 4.36 | 0.51 | 0.62 | 0.115 | 0.043 | 0.05 | 0.21 | 0.019 | 0.01 | 17.2 | top-and-bottom blowing |
| | 2 | 4.42 | 0.48 | 0.55 | 0.126 | 0.039 | 0.04 | 0.19 | 0.022 | 0.02 | 16.8 | top-and-bottom blowing |
| | 3 | 4.47 | 0.39 | 0.68 | 0.122 | 0.021 | 0.06 | 0.24 | 0.014 | 0.01 | 17.3 | top-and-bottom blowing |
| | 4 | 4.51 | 0.38 | 0.66 | 0.114 | 0.037 | 0.04 | 0.26 | 0.017 | 0.01 | 15.4 | top-and-bottom blowing |
| | 5 | 4.48 | 0.42 | 0.58 | 0.108 | 0.031 | 0.05 | 0.28 | 0.021 | 0.01 | 17.3 | top-and-bottom blowing |
| | 6 | 4.37 | 0.44 | 0.61 | 0.120 | 0.028 | 0.05 | 0.21 | 0.023 | 0.01 | 17.6 | top-and-bottom blowing |
| | 7 | 4.41 | 0.53 | 0.51 | 0.118 | 0.019 | 0.06 | 0.17 | 0.010 | 0.005 | 15.8 | top-and-bottom blowing |

TABLE 3

| | Run No. | Molten iron composition (wt %) C | Si | Mn | P | S | Blowing-out composition (wt %) C | Mn | P | S | T.Fe | Blowing mode |
|---|---|---|---|---|---|---|---|---|---|---|---|---|
| Comparative Example 1 | 8 | 4.51 | 0.51 | 0.53 | 0.121 | 0.015 | 0.07 | 0.10 | 0.024 | 0.010 | 19.4 | top-and-bottom blowing |
| | 9 | 4.38 | 0.49 | 0.65 | 0.125 | 0.038 | 0.06 | 0.09 | 0.029 | 0.02 | 21.3 | top-and-bottom blowing |
| | 10 | 4.47 | 0.41 | 0.68 | 0.122 | 0.042 | 0.04 | 0.09 | 0.031 | 0.02 | 20.5 | top-and-bottom blowing |
| | 11 | 4.46 | 0.48 | 0.60 | 0.110 | 0.045 | 0.05 | 0.14 | 0.027 | 0.03 | 18.2 | top-and-bottom blowing |
| Comparative Example 2 | 12 | 4.48 | 0.53 | 0.55 | 0.109 | 0.044 | 0.04 | 0.19 | 0.021 | 0.02 | 16.1 | bottom blowing |
| | 13 | 4.34 | 0.48 | 0.54 | 0.114 | 0.035 | 0.06 | 0.21 | 0.019 | 0.01 | 14.4 | bottom blowing |

As seen from Tables 1, 2 and 3, the concentration of iron value (T.Fe) in the slag in Example 1 where top-and-bottom blowing was conducted with the value of $X_0/Y$ set to 1.3 or less is significantly low as compared with Comparative Example 1 wherein top-and-bottom blowing was conducted with the value of $X_0/Y$ set to above 1.3, and approximates the (T.Fe) value of Comparative Example 2 wherein refining was conducted by bottom blowing only (Q-BOP). This demonstrates that the enhanced agitation effect is achieved in practice when the position of the tuyeres is set in relation to the lance height and the angles $\theta_1$ and $\theta_2$ associated with the injection hole of the lance such that $X_0/Y$ is equal to or less than 1.3.

The following is an example in which the process of this invention was applied to a 100-ton top-and-bottom blown converter on an actual operation scale.

EXAMPLE 2

Figure 6:
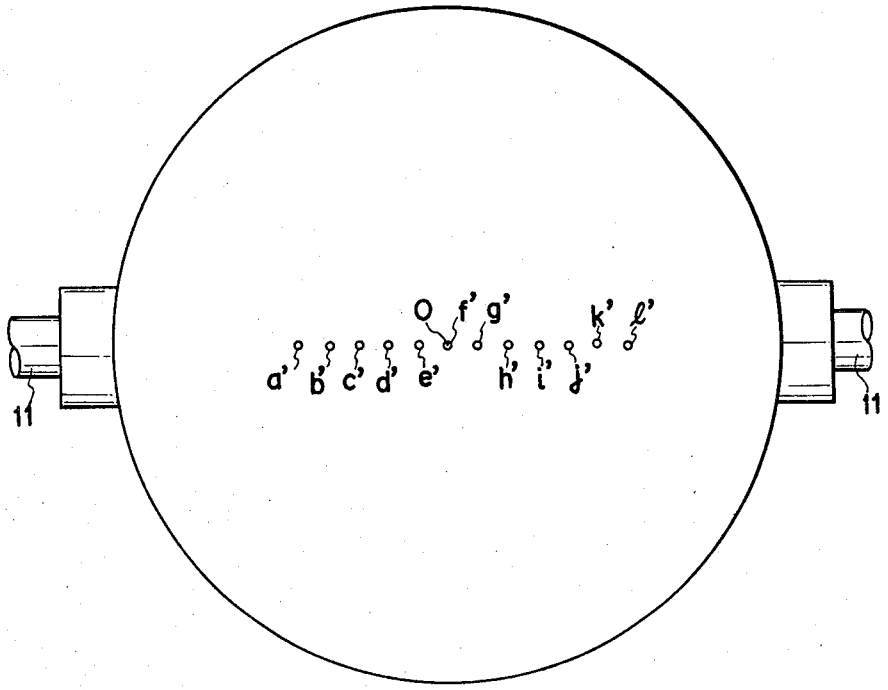
FIG. 6 is a diagrammatic plan view showing the position of the bottom blowing tuyeres in the converter used in Examples 2 and 3.

The converter used had an inner diameter of 3,600 mm, and the tuyeres used were double pipe tuyeres each consisting of inner and outer pipes between which propane gas was passed as a tuyere protecting gas. The inner pipe of the tuyere had an inner diameter of 20 mm. Twelve tuyeres a'–l' were arranged along a straight line parallel to a trunnion 11 at a spacing of 200 mm as shown in FIG. 6. Four tuyeres d', e', h' and i' were chosen among them and pure oxygen was blown through these tuyeres at a total flow rate of 40–60 $Nm^3$/min. while pure oxygen was blown through the lance at a flow rate of 150 $Nm^3$/min. The angles associated with the lance were: $\theta_1=12°$ and $\theta_2=20°$. The lance height L was set to 2.3 m for an initial 2 minutes and then fixed at 1.9 m. The value of $X_0/Y$ at $L=1.9$ was less than 1.0.

In this experiment, the concentration of iron value (T.Fe) in the slag was 15.5% at the time of blowing out at C=0.05%. When refining by top blowing only was conducted under the same conditions except that the bottom blowing gas was not blown, the value of (T.Fe) was 18.7%. The value of (T.Fe) is significantly reduced by the process of the invention. In the above-described top-and-bottom blowing experiment, the amount of metal adhered to the lance due to spitting of the molten metal was larger than in the case of refining by top blowing only and the spitting caused an accidental water leakage from the lance. It might be effective to increase the lance height in order to prevent such adhesion of metal to the lance and such a water leakage accident, although it is difficult in practice to increase the lance height without the sacrifice of refining efficiency. It was believed that spitting increased the amount of metal adhered to the lance and caused an accidental water leak from the lance since the value of $X_0/Y$ was less than 1.0, that is, bubbles of the bottom-blowing gas moved upward to an area of the molten iron surface within the hot spot in Example 2. Then the inventors made another experiment in which the bottom blowing gas was blown through those tuyeres positioned outside the hot spot region.

EXAMPLE 3

The outside four tuyeres a', b', k', and l' were chosen among the tuyeres a' to l' shown in FIG. 6, and pure oxygen was blown through these tuyeres. In this case, all the distances X between the respective tuyeres and the center of converter bottom satisfied the condition $1.0 \leqq X/Y \leqq 1.3$. That is, all the tuyeres were positioned within the range of 1.0Y to 1.3Y. The remaining conditions were the same as in Example 2.

In this Example 3, even when the flow rate of the bottom blowing gas was as high as 60 $Nm^3$/min., the amount of metal adhered to the lance due to spitting was as small as in the refining by top blowing only and no water leakage due to spitting occurred.

These facts suggest that the tuyeres for blowing a bottom blowing gas may desirably be positioned so that the distances X from the respective tuyeres and the center of the converter bottom satisfy the condition $X/Y \geqq 1.0$ when the adhesion of metal to the lance should be minimized and a lance water leakage accident should be avoided. The tuyeres must be arranged so as to satisfy $X_0/Y \leqq 1.3$ in order to obtain the enhanced agitation effect due to the interference of the bottom blowing gas with the top blowing gas as previously described. In summary, in order to enhance the agitation effect and to prevent both the adhesion of metal to the lance and the leakage of water from the lance, it is most desirable that the tuyeres be arranged so that the distances X of all the tuyeres may satisfy the condition $1.0 \leqq X/Y \leqq 1.3$. It is to be noted that even when some tuyeres among a plurality of tuyeres are arranged so as to result in $X/Y < 1.0$, prevention of metal adhesion and lance water leakage is achieved to some extent if $X/Y \geqq 1.0$ is satisified for the remaining tuyeres. In general, half or more of the plurality of tuyeres are preferably arranged so as to satisfy the condition $1.0 \leqq X/Y \leqq 1.3$.

The following is an example in which an actual operation was carried out by the process of the invention using an inert gas as the bottom blowing gas.

EXAMPLE 4

Figure 7:
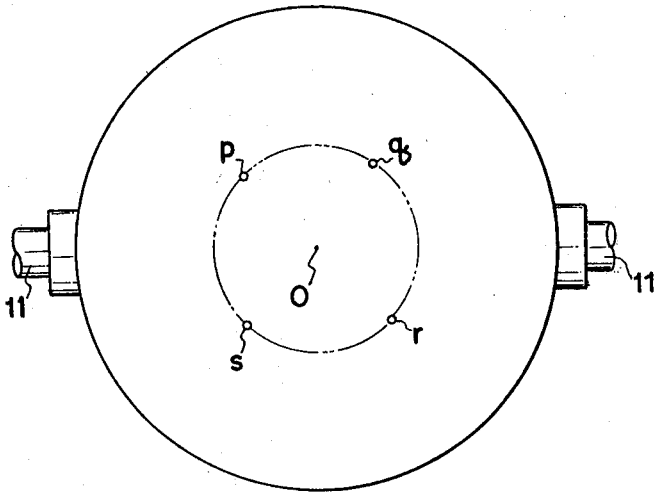
FIG. 7 is a diagrammatic plan view showing the position of the bottom blowing tuyeres in the converter used in Example 4.

A 150-ton top-blown converter having a maximum diameter of 4,800 mm at the barrel was equipped at its bottom with four single pipe tuyeres having an inner diameter of 4 mm which were arranged at positions p, q, r and s in FIG. 7, that is, in central symmetry, on a circle of 1000 mm radius coaxial with the converter bottom. Refining was conducted by blowing Ar gas into the molten steel through the tuyeres and blowing pure oxygen gas onto the molten iron surface through the lance. The angle of inclination of the lance nozzle was 12°, the angle of spray of the lance nozzle was 10°, and the lance height was 2,000 mm during the decarbonization period which occupied the majority of the refining process. In this case, $X_0/Y$ ($=X/Y$) was 1.24.

In Example 4, slopping due to the excessive oxidation of the slag was substantially avoided, and the iron yield was improved by 0.5% over the refining by top blowing only without bottom blowing.

The lance height may be changed during a single refining process as described in the foregoing Example, although the lance height is a minimum during the decarbonization period occupying the majority of the entire refining process. Therefore, the values of $X_0$ and X for the tuyeres may be determined using the value of Y calculated from the lance height L used in the decarbonization period.

INDUSTRIAL APPLICABILITY

This invention is generally applicable to the top-and-bottom blown converter steel making process, and is effective in improving the iron yield when applied to large-scale actual operation.

We claim:

1. A top and bottom blown converter steel making process comprising:

blowing an oxidizing gas onto the surface of molten iron in the converter through a lance aligned with the central vetical axis of the converter and disposed above the molten iron surface a distance L and having lance discharge holes with the hole axes at an angle $\theta_1$ to said central vertical axis and each discharge hole having an angle of dispersion $\theta_2$ for bringing the oxidizing gas into direct contact with the molten iron to form a hot spot having a horizontal distance Y between the central vertical axis of the converter and the outermost boundary of the hot spot according to the following formula:

$$Y=L \tan (\theta_1+\theta_2/2)$$

and blowing gas into the molten iron through a plurality of tuyeres arranged in the bottom of the converter with the maximum distance $X_0$ among the distances X between the respective tuyeres and the center of the bottom of the converter being no greater than 1.3 times the distance Y.

2. A process as claimed in claim 1 wherein at least half the said distances X are from 1.0 to 1.3 times the distance Y.

3. A process as claimed in claim 1 wherein all the said distances X are from 1.0 to 1.3 times the distance Y.

4. A process as claimed in claim 1 wherein the gas blown through said tuyeres is an oxidizing gas.

5. A process as claimed in claim 1 wherein the gas blown through said tuyeres is an inert gas.

6. A top and bottom blown converter for steel making, comprising:

a converter housing;

a lance aligned with the central vertical axis of the converter housing for blowing an oxidizing gas onto the surface of molten iron in the converter housing and disposed above the molten iron surface a distance L and having lance discharge holes with the hole axes at an angle $\theta_1$ to said central vertical axis and each discharge hole having an angle of dispersion $\theta_2$ for bringing the oxidizing gas into direct contact with the molten iron to form a hot spot having a horizontal distance Y between the central vertical axis of the converter and the outermost boundary of the hot spot according to the following formula:

$$Y=L \tan (\theta_1+\theta_2/2)$$

and a plurality of tuyeres arranged in the bottom of the converter for blowing gas into the molten iron, said tuyeres being spaced from the center of the bottom of the converter housing with the maximum distance $X_0$ among the distances X between the respective tuyeres and the center of the bottom of the converter being no greater than 1.3 times the distance Y.

7. A converter as claimed in claim 6 wherein at least half the said distances X are from 1.0 to 1.3 times the distance Y.

8. A converter as claimed in claim 6 wherein all the said distances X are from 1.0 to 1.3 times the distance Y.

* * * * *